US008894067B2

(12) United States Patent
Futrell, III et al.

(10) Patent No.: US 8,894,067 B2
(45) Date of Patent: Nov. 25, 2014

(54) BOARD GAME HAVING MULTI-LEVEL PLAYING RULES

(76) Inventors: Henley W. Futrell, III, Conroe, TX (US); Bobbie J. Futrell, Conroe, TX (US)

( * ) Notice: Subject to any disclaimer, the term of this patent is extended or adjusted under 35 U.S.C. 154(b) by 1265 days.

(21) Appl. No.: 12/136,202

(22) Filed: Jun. 10, 2008

(65) Prior Publication Data

US 2009/0302538 A1 Dec. 10, 2009

(51) Int. Cl.
*A63F 3/00* (2006.01)

(52) U.S. Cl.
USPC ..... 273/241; 273/278

(58) Field of Classification Search
USPC ..... 273/241, 287, 256, 278
See application file for complete search history.

(56) References Cited

U.S. PATENT DOCUMENTS

| | | | | |
|---|---|---|---|---|
| 2,026,082 | A | | 12/1935 | Darrow |
| 4,053,157 | A | | 10/1977 | Cowan |
| 4,440,397 | A | | 4/1984 | Butner |
| 4,456,259 | A | | 6/1984 | Antal et al. |
| 4,522,407 | A | | 6/1985 | Hatherley |
| 4,648,601 | A | * | 3/1987 | Carmichael ..... 273/241 |
| 4,932,666 | A | * | 6/1990 | Corle ..... 273/249 |
| 4,932,668 | A | | 6/1990 | Stewart |
| 4,936,589 | A | | 6/1990 | Sinclair |
| 5,261,672 | A | | 11/1993 | Jordan |
| 5,503,399 | A | | 4/1996 | Honeywill |
| 5,829,746 | A | | 11/1998 | Pacella |
| 6,106,300 | A | | 8/2000 | Kiyosaki et al. |
| 6,164,650 | A | * | 12/2000 | Wilkins et al. ..... 273/256 |
| 7,287,753 | B1 | | 10/2007 | Brigidi |
| 2005/0151318 | A1 | | 7/2005 | Tarantini |
| 2005/0242502 | A1 | | 11/2005 | Trivedi |
| 2006/0043681 | A1 | | 3/2006 | Wallace et al. |
| 2006/0082061 | A1 | | 4/2006 | Kertcher |
| 2006/0202417 | A1 | | 9/2006 | DeLaCruz-Newlan |
| 2007/0132181 | A1 | | 6/2007 | Daniels |
| 2007/0135191 | A1 | | 6/2007 | Baker et al. |

* cited by examiner

*Primary Examiner* — Vishu K. Mendiratta
(74) *Attorney, Agent, or Firm* — John J. Love; Claude Cooke, Jr.; Cooke Law Firm

(57) ABSTRACT

A board game is provided having the theme Death and Taxes. Multiple levels of paths of spaces are indicated on a board, each level having differing rules affecting the amount of scrip currency that a player receives or loses in playing. Players' pieces are moved to differing levels dependent on the amount of currency assigned to that player (Net Worth).

11 Claims, 17 Drawing Sheets

(a)

(b)

SWEEPSTAKES

TICKET NUMBER

IF MATCHED WITH OTHER TICKET OF SAME NUMBER,
BEARER WINS $ 1,000,000.00

(a)

SWEEPSTAKES

TICKET NUMBER 1

IF MATCHED WITH OTHER TICKET OF SAME NUMBER,
BEARER WINS $ 1,000,000.00

(b)

FIG. 4

BOARD GAME HAVING MULTI-LEVEL PLAYING RULES

BACKGROUND OF THE INVENTION

1. Field of Invention

The present invention relates generally to board games and, more specifically, to games in which the surface has a pattern divided into plural spaces, and where at least one contest element moves over the pattern in accordance with rules for multiple levels that relate the amount of movement over the pattern to the spaces.

2. Description of Related Art

U.S. Pat. No. 2,026,082, "Board Game Apparatus," issued to Charles B. Darrow on Dec. 31, 1935 discloses a board game simulating barter, trade and bargaining, a board game apparatus acting as a playing field affording a plurality of spaces forming a track for continuity of play, a set of differentiated playing pieces for registering movement, and dice or the like to control certain movements of the game. ("Monopoly")

U.S. Pat. No. 5,261,672, "Method of Playing a Tax Board Game," issued to Carolyn M. Jordan on Nov. 16, 1993 discloses a board game having a single path including an inner path and outer path having coloration spaces indicating expenses to be born by players, penalty spaces, tax break spaces, and spaces indicating players to draw a card from a first card deck to determine income.

U.S. Pat. No. 7,185,890, "Method and Apparatus for Playing a Stock Trading Simulation Game," issued to Hariprasad S. Trivedi on Mar. 6, 2007 discloses a method of playing a stock trading simulation game and providing a game apparatus including a game board having a plurality of spaces marked thereon defining a path of movement on the game board, with a portion of the plurality of spaces representing individual stock positions. A game apparatus may include the game board, a trade transaction sheet for recording trades of stock positions, a hidden bid card for secretly recording hidden bids, and a number of game pieces including open turn and hidden turn game pieces.

More variety in board games is needed. A subject of universal interest, such as "Death and Taxes," can be valuable in teaching while entertaining players in a wide range of ages.

SUMMARY OF THE INVENTION

This invention provides a board game on the subject matter of Death and Taxes comprising multiple levels of play by providing a plurality of levels comprised of a plurality of spaces around which game play progresses. The level on which a player progresses is determined by an internal condition of the game, and victory is achieved by a predetermined value of the internal condition.

BRIEF DESCRIPTION OF THE DRAWINGS

FIG. 1(*b*) is a view of the dice (randomizers) used in the game.

FIG. 1(*c*) is a view of the status pad.

FIG. 1(*d*) is a view of the player indicators.

FIG. 3(*b*) is an exemplar Occupation Card.

FIG. 4(*a*) is an illustration of a Sweepstakes Card template.

FIG. 4(*b*) is an exemplar Sweepstakes Card.

FIG. 8(*a*) is a flowchart of the operations associated with the Audit space.

FIG. 8(*b*) is a flowchart of the operations associated with the Bonus space.

FIG. 8(*c*) is a flowchart of the operations associated with the Death space.

FIG. 8(*d*) is a flowchart of the operations associated with the Disaster space.

FIG. 8(*e*) is a flowchart of the operations associated with the Informer space.

FIG. 8(*f*) is a flowchart of the operations associated with the Lottery space.

FIG. 8(*g*) is a flowchart of the operations associated with the Occupation space.

FIG. 8(*h*) is a flowchart of the operations associated with the Refund space.

FIG. 8(*i*) is a flowchart of the operations associated with the Revive space.

FIG. 8(*j*) is a flowchart of the operations associated with the Roll Again space.

FIG. 8(*k*) is a flowchart of the operations associated with the Swindler space.

FIG. 8(*l*) is a flowchart of the operations associated with the Tragedy space.

FIG. 8(*m*) is a flowchart of the operations associated with the Unemployment space.

FIG. 8(*n*) is a flowchart of the operations associated with the Welfare space.

FIG. 8(*o*) is a flowchart of the operations associated with the You're Fired! space.

DETAILED DESCRIPTION

Figure 1:
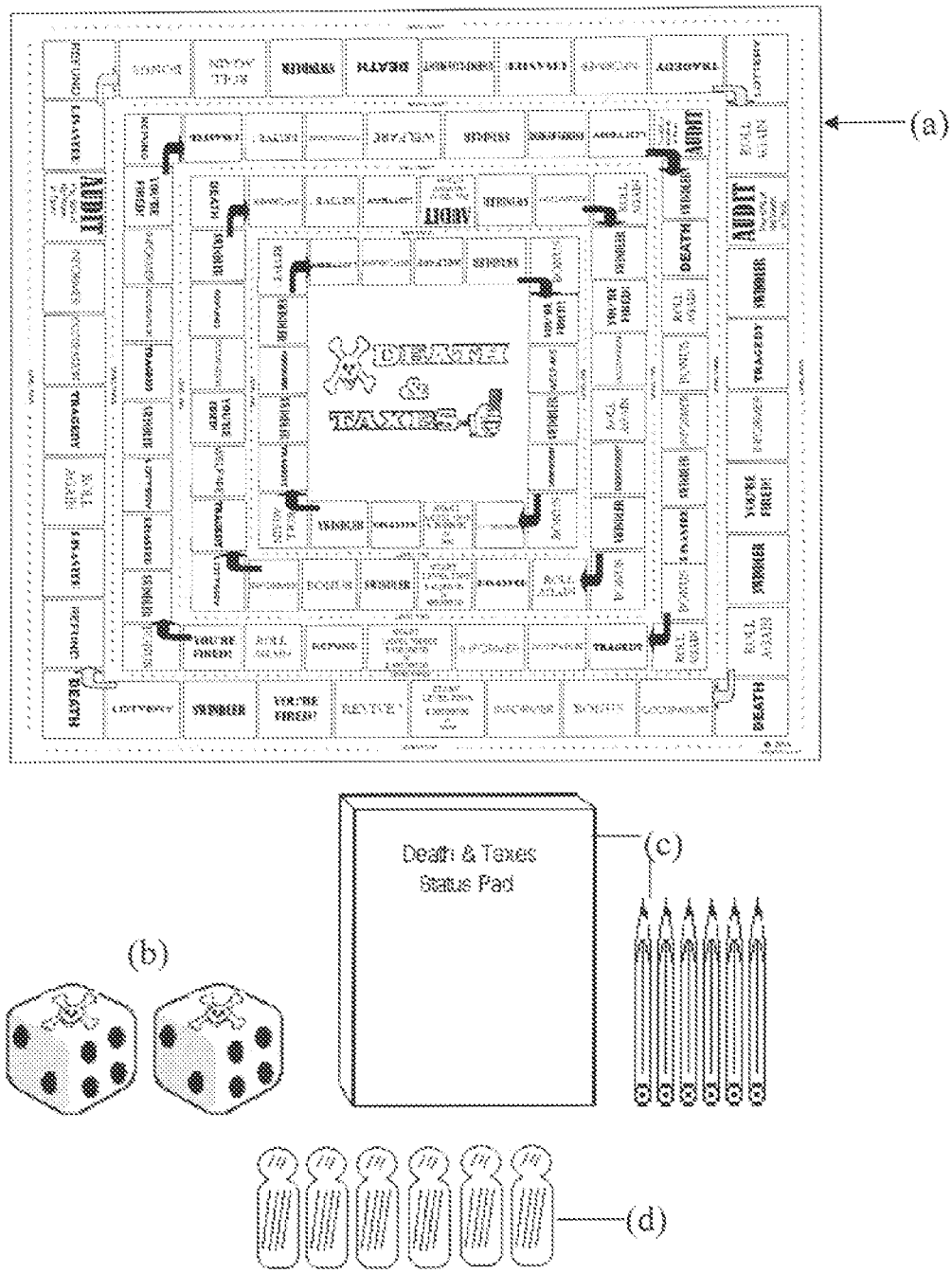
FIG. 1(*a*) is a plan view of the playing board.

Illustrated in FIGS. 1-8(*o*) is a preferred embodiment for a method for playing a game on the subject matter of death and taxes. Referring to FIG. 1(*a*), a board is illustrated. A randomizer (pair of dice) is indicated in FIG. 1(*b*). A device for recording game information is included at FIG. 1(*c*), and player indicators are indicated at FIG. 1(*d*). In one embodiment, the randomizer is two six-sided die in which the side indicating the integer "one" has been replaced with a depiction of a skull and crossbones. The device for recording game information indicated in FIG. 1(*c*) is a pad of paper with "Death & Taxes Status Pad" embossed on it and a writing instrument such as a pencil. The player indicators shown in FIG. 1(*d*) may be wooden game pieces.

Although the embodiment disclosed herein contemplates a standard board game, the method could be practiced by electronic display of the board in FIG. 1(*a*), use of a computer program to output a random integer within a selected range, electronic display of player indicators, and electronic display and storage of game information. This would not alter the rules or procedure of the game.

Figure 2:
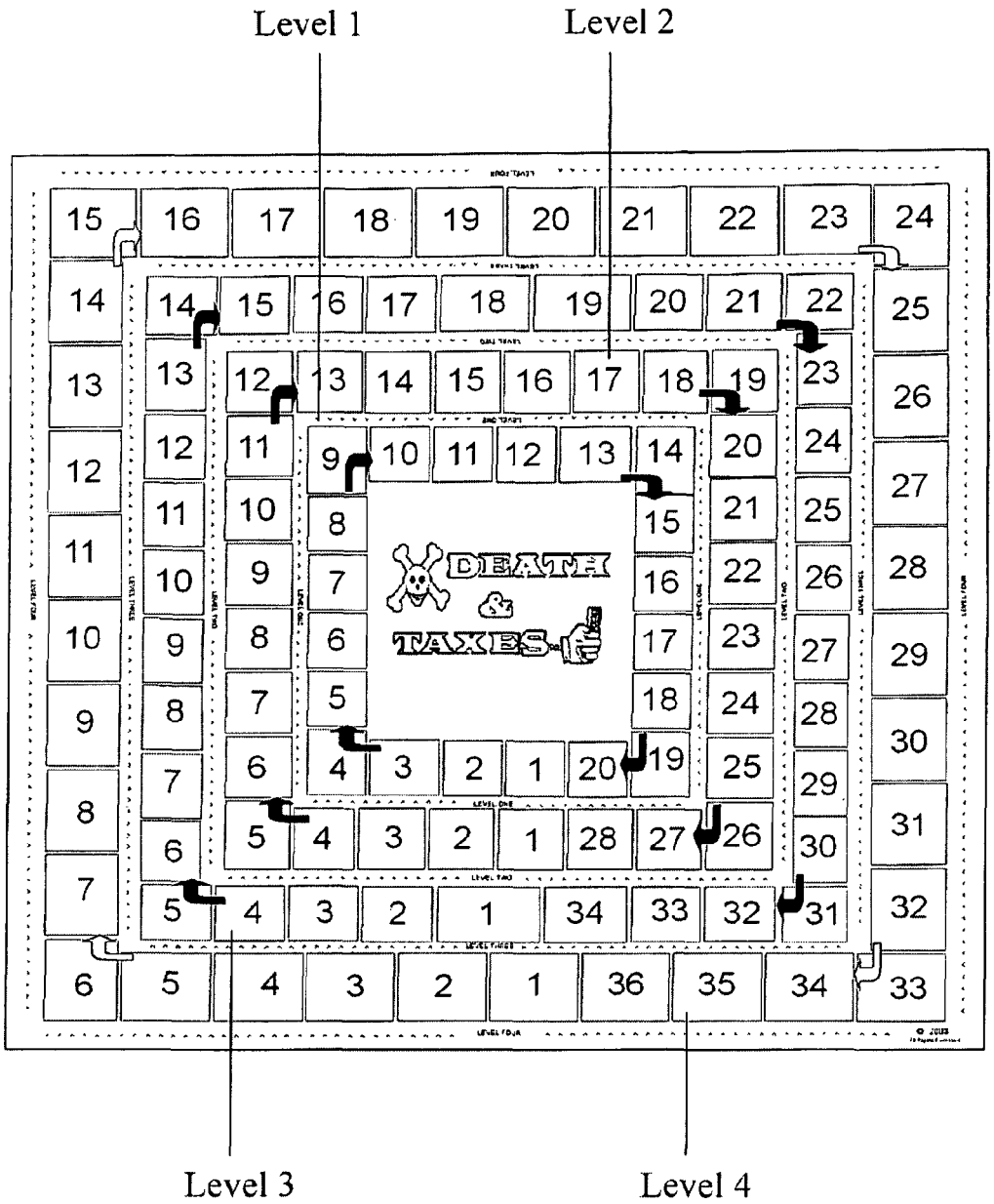
FIG. 2 is a detailed view of the playing board, spaces, and levels.

Referring to FIG. 2, a plurality of game spaces corresponding to predetermined operations are depicted. A plurality of spaces comprises a path on which game play progresses, forming a level of play. The plurality of levels each has a start space on which players promoted or demoted to that level begin, and each level corresponds to a predetermined range of Net Worth. Net Worth is defined as the value of scrip money recorded as being owned by the individual players in the game. Each player records his/her Net Worth on a Status Pad, such as shown in FIG. 1(*c*). In one embodiment, the start of the initial level is depicted at Level 1, Space 1, and corresponds to a predetermined range of Net Worth less than $40,000. In one embodiment, there are four levels; Level 2 corresponds to the Net Worth Range greater than $40,000 to $99,999; Level 3 corresponds to the Net Worth Range greater than $100,000 to $499,999; and Level 4 corresponds to a Net Worth greater than $500,000. The number of levels is in the range of two to ten. A preferred number is four. In one embodiment, having four levels, the list of game spaces is as follows:

Level 1, Space 1: Start Level 1
Level 1, Space 2: Disaster
Level 1, Space 3: Swindler
Level 1, Space 4: Roll Again
Level 1, Space 5: Tragedy
Level 1, Space 6: Swindler
Level 1, Space 7: Unemployment
Level 1, Space 8: Swindler
Level 1, Space 9: Revive!
Level 1, Space 10: Lottery
Level 1, Space 11: Informer
Level 1, Space 12: Welfare
Level 1, Space 13: Swindler
Level 1, Space 14: Bonus
Level 1, Space 15: You're Fired!
Level 1, Space 16: Welfare
Level 1, Space 17: Swindler
Level 1, Space 18: Unemployment
Level 1, Space 19: Bonus
Level 1, Space 20: Occupation
Level 2, Space 1: Start Level 2
Level 2, Space 2: Swindler
Level 2, Space 3: Bonus
Level 2, Space 4: Informer
Level 2, Space 5: Lottery
Level 2, Space 6: Tragedy
Level 2, Space 7: Welfare
Level 2, Space 8: You're Fired
Level 2, Space 9: Occupation
Level 2, Space 10: Refund
Level 2, Space 11: Swindler
Level 2, Space 12: Death
Level 2, Space 13: Informer
Level 2, Space 14: Revive!
Level 2, Space 15: Lottery
Level 2, Space 16: Audit, 10% Taxes
Level 2, Space 17: Swindler
Level 2, Space 18: Occupation
Level 2, Space 19: Roll Again
Level 2, Space 20: Swindler
Level 2, Space 21: You're Fired
Level 2, Space 22: Welfare
Level 2, Space 23: Swindler
Level 2, Space 24: Unemployment
Level 2, Space 25: Swindler
Level 2, Space 26: Bonus
Level 2, Space 27: Roll Again
Level 2, Space 28: Disaster
Level 3, Space 1: Start Level 3
Level 3, Space 2: Refund
Level 3, Space 3: Roll Again
Level 3, Space 4: You're Fired!
Level 3, Space 5: Bonus
Level 3, Space 6: Swindler
Level 3, Space 7: Disaster
Level 3, Space 8: Lottery
Level 3, Space 9: Swindler
Level 3, Space 10: Tragedy
Level 3, Space 11: Occupation
Level 3, Space 12: Informer
Level 3, Space 13: You're Fired!
Level 3, Space 14: Refund
Level 3, Space 15: Disaster
Level 3, Space 16: Revive!
Level 3, Space 17: Occupation
Level 3, Space 18: Welfare
Level 3, Space 19: Swindler
Level 3, Space 20: Unemployment
Level 3, Space 21: Lottery
Level 3, Space 22: Audit, 30% Taxes
Level 3, Space 23: Swindler
Level 3, Space 24: Death
Level 3, Space 25: Roll Again
Level 3, Space 26: Bonus
Level 3, Space 27: Informer
Level 3, Space 28: Swindler
Level 3, Space 29: Disaster
Level 3, Space 30: Bonus
Level 3, Space 31: Roll Again
Level 3, Space 32: Tragedy
Level 3, Space 33: Occupation
Level 3, Space 34: Informer
Level 4, Space 1: Start Level 4
Level 4, Space 2: Revive!
Level 4, Space 3: You're Fired!
Level 4, Space 4: Swindler
Level 4, Space 5: Lottery
Level 4, Space 6: Death
Level 4, Space 7: Refund
Level 4, Space 8: Disaster
Level 4, Space 9: Roll Again
Level 4, Space 10: Tragedy
Level 4, Space 11: Occupation
Level 4, Space 12: Informer
Level 4, Space 13: Audit, 50% Taxes
Level 4, Space 14: Disaster
Level 4, Space 15: Refund
Level 4, Space 16: Bonus
Level 4, Space 17: Roll Again
Level 4, Space 18: Swindler
Level 4, Space 19: Death
Level 4, Space 20: Unemployment
Level 4, Space 21: Disaster
Level 4, Space 22: Informer
Level 4, Space 23: Tragedy
Level 4, Space 24: Lottery
Level 4, Space 25: Roll Again
Level 4, Space 26: Audit, 50% Taxes
Level 4, Space 27: Swindler
Level 4, Space 28: Tragedy
Level 4, Space 29: Informer
Level 4, Space 30: You're Fired
Level 4, Space 31: Swindler
Level 4, Space 32: Roll Again
Level 4, Space 33: Death
Level 4, Space 34: Occupation
Level 4, Space 35: Bonus
Level 4, Space 36: Informer.

The list may be amended in order of frequency of repetition of each space on any level without changing the operation or method of the game.

Figure 3:
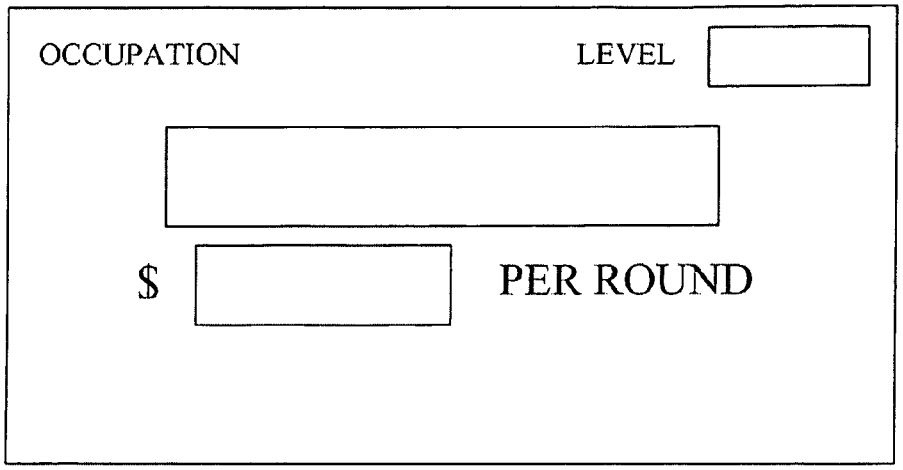
FIG. 3(*a*) is an illustration of an Occupation Card template.
Figure 3:
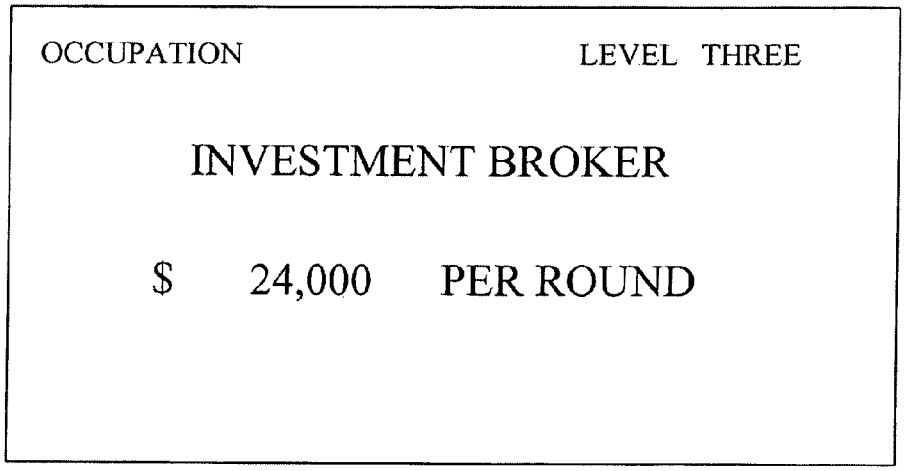
Figure 5:
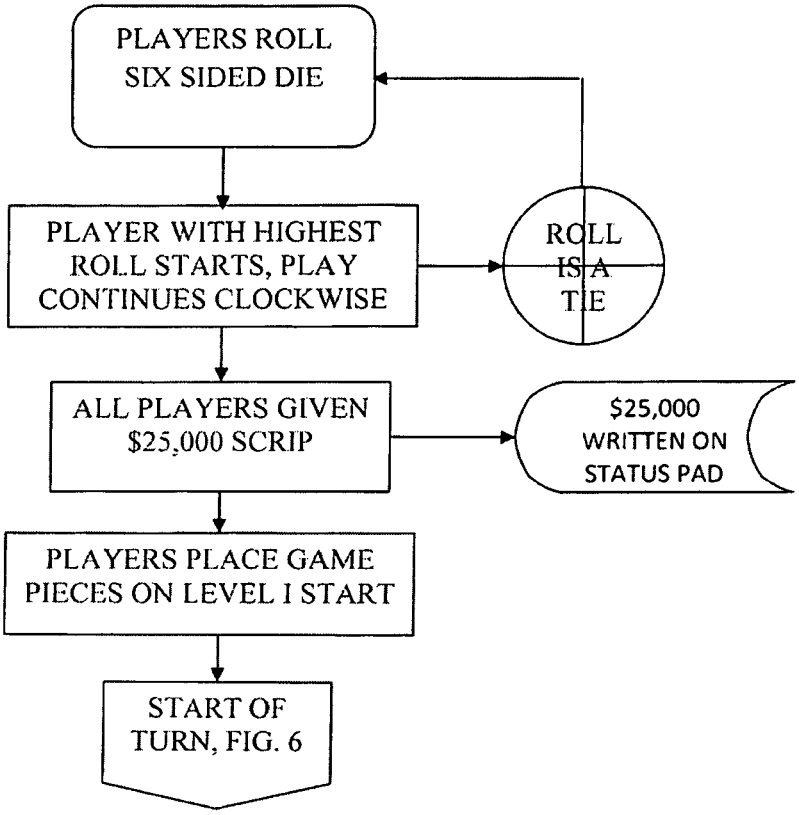
FIG. 5 is a flowchart of the start of game play (setup).

Referring to FIG. 3(*a*), cards depicting game information are illustrated by a template. An exemplar game information card is shown in FIG. 3(*b*). In one embodiment, the cards shown in FIG. 3(*a*) are Occupation Cards. Occupation Cards contain job titles and salary information denoted in dollars per round. The Occupation Cards illustrated at FIG. 3(*b*) correspond to the Level 3, with a job title of Investment Broker, and a Salary of $24,000 per round. This dollar amount is added to Net Worth of a player holding the card at the end of each Round. In one embodiment, there are four levels with fifteen Occupations Cards per level, with the following game information, for example:

Level 1, Fast Food Cook, $200 per round;
Level 1, Worker at Sav-Mart, $250 per round;
Level 1, Convenience Store Clerk, $275 per round;
Level 1, Security Guard, $300 per round;
Level 1, Hair Dresser, $350 per round;
Level 1, Pizza Delivery Driver, $375 per round;
Level 1, Warehouse Manager, $400 per round;
Level 1, Dental Assistant, $450 per round;
Level 1, Circus Clown, $475 per round;
Level 1, Police Academy Student, $475 per round;
Level 1, Auto Mechanic, $600 per round;
Level 1, Florist, $700 per round;
Level 1, Disk Jockey, $800 per round;
Level 1, Photographer, $900 per round;
Level 1, Telemarketer, $1,000 per round;
Level 2, Farmer, $1,100 per round;
Level 2, Carpenter, $1,200 per round;
Level 2, Plumber, $1,300 per round;
Level 2, Ranch Hand, $1,500 per round;
Level 2, Volunteer Fireman, $1,500 per round;
Level 2, Social Worker, $2,100 per round;
Level 2, Forest Ranger, $2,200 per round;
Level 2, Airline Steward(ess), $2,300 per round;
Level 2, Secretary, $2,500 per round;
Level 2, Real Estate Agent, $2,600 per round;
Level 2, Accountant, $2,700 per round;
Level 2, Policeman, $2,800 per round;
Level 2, Inventor, $2,900 per round;
Level 2, Registered Nurse, $3,000 per round;
Level 3, Chef, $4,300 per round;
Level 3, Private Investigator, $4,400 per round;
Level 3, College Professor, $4,600 per round;
Level 3, Bio-Chemist, $4,800 per round;
Level 3, Para-Legal, $5,000 per round;
Level 3, Dentist, $5,200 per round;
Level 3, County Sheriff, $5,400 per round;
Level 3, Doctor, $5,600 per round;
Level 3, Pro Sports Mascot, $5,800 per round;
Level 3, Lawyer, $6,000 per round;
Level 3, Architect, $15,000 per round;
Level 3, Cattleman, $18,000 per round;
Level 3, Movie Star, $20,000 per round;
Level 3, Engineer, $21,000 per round;
Level 3, Investment Broker, $24,000 per round;
Level 4, Hollywood Producer, $27,000 per round;
Level 4, T.V. Evangelist, $30,000 per round;
Level 4, Scientist, $33,000 per round;
Level 4, Astronaut, $36,000 per round;
Level 4, Vice-Chairman, $38,000 per round;
Level 4, Best Selling Author, $41,000 per round;
Level 4, High Fashion Designer, $42,000 per round;
Level 4, Lieutenant Governor, $43,000 per round;
Level 4, Pro Sports Agent, $44,000 per round;
Level 4, Open Heart Surgeon, $45,000 per round;
Level 4, Governor, $46,000 per round;
Level 4, Company President, $49,000 per round;
Level 4, Chairman of the Board, $50,000 per round.

The occupations and compensation per round may vary without changing the operation or method of the game.

Referring to FIG. 4, cards depicting game information are illustrated in a template at FIG. 4(*a*), and an exemplar of a card depicting game information is depicted at FIG. 4(*b*). In one embodiment, the cards in FIG. 4 are Sweepstakes Cards. Sweepstakes Cards are distributed randomly with the Occupation Cards illustrated in FIG. 4(*a*) and FIG. 4(*b*). In one embodiment, Sweepstakes Cards are numbered in pairs, 1-5. If a player draws a Sweepstakes Card, and matches a pair, he adds a predetermined amount to his Net Worth. In one embodiment, this predetermined amount is $1,000,000.

The game logic will now be discussed. Flowcharts illustrated in FIG. 5-8(*o*) map the game logic and operation. The following flowchart convention is used in the diagrams:

Terminator: The Start or End of a Process
Process: An Action Performed in the Operation
Decision: Asks a Question, Answer Determines Operation Flow
Connector: Connects Two or More Parts of Flowchart Together
Or: Connects Two Alternate Steps
Off Page Connector: Connects Parts of Flowcharts on Separate Pages
Manual Operation: Player Performs a Manual Operation
Stored Data: Data Written to Storage Medium
→ Arrows: Indicate Flow Referring to FIG. 5, a flowchart of the initial setup of game play is depicted. The starting player is selected. The players operate the randomizer illustrated at FIG. 1(*b*). The player with the highest resulting value begins game play, and play continues clockwise with players seated around playing field or board illustrated at FIG. 1(*a*). If the result is a tie, the randomizer is operated until a highest result is obtained. All players are given a predetermined amount of scrip as a starting Net Worth, which is recorded on the Status Pad at FIG. 1(*c*). Players place Player Indictors Illustrated at FIG. 1(*d*) on Level One Start, illustrated at FIG. 2, Level 1, and Space 1. This is the start of the initial player's Turn, and also the start of the Round. The player's Turn will end when he has operated the randomizer, moved that player's player indicator, landed on a space, and performed the operation of the space. A Round ends when all players have had their Turn. In one embodiment, players roll a six-sided die to determine who goes first.

Figure 6:
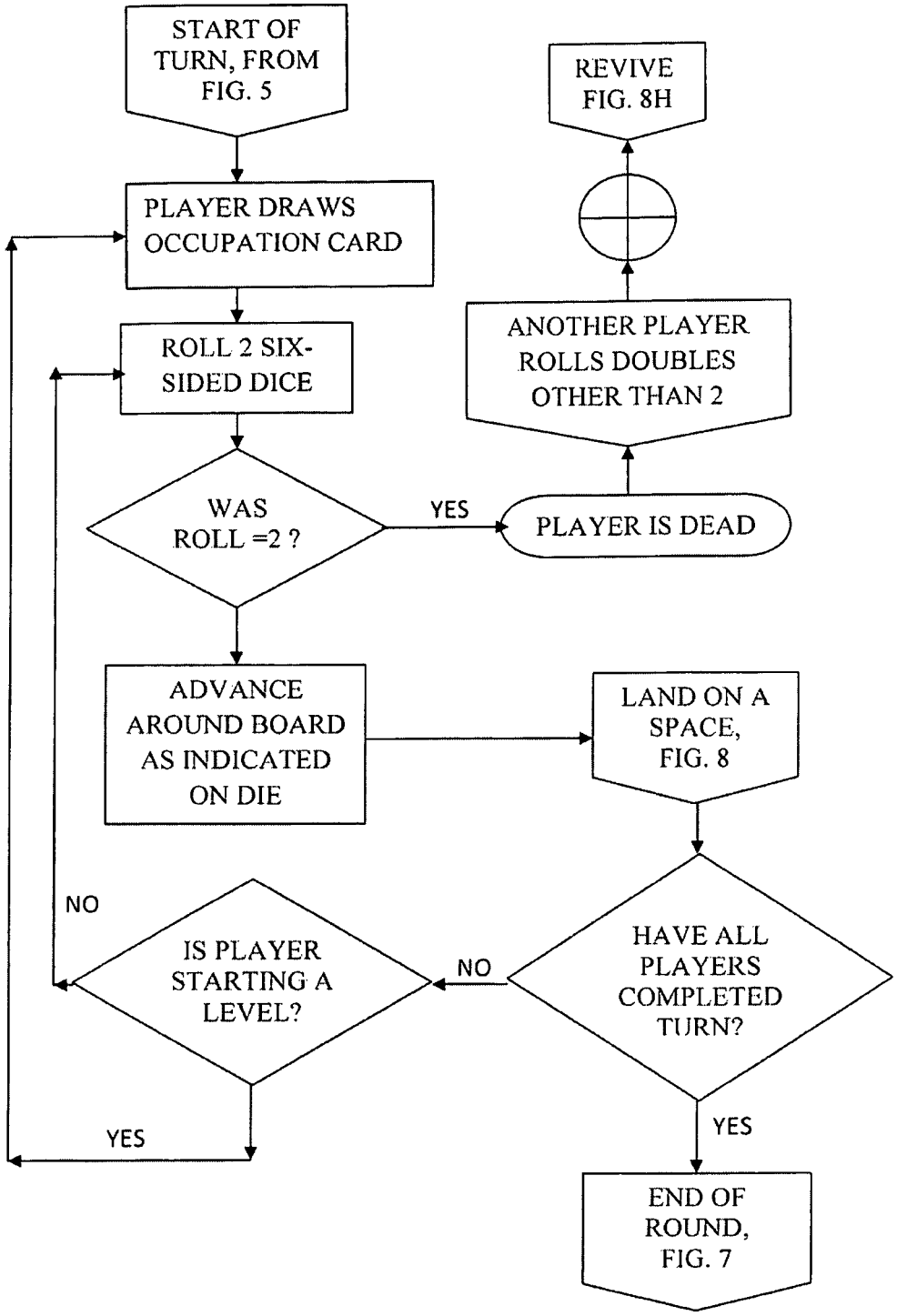
FIG. 6 is a flowchart of the beginning of a turn.
Figure 8:
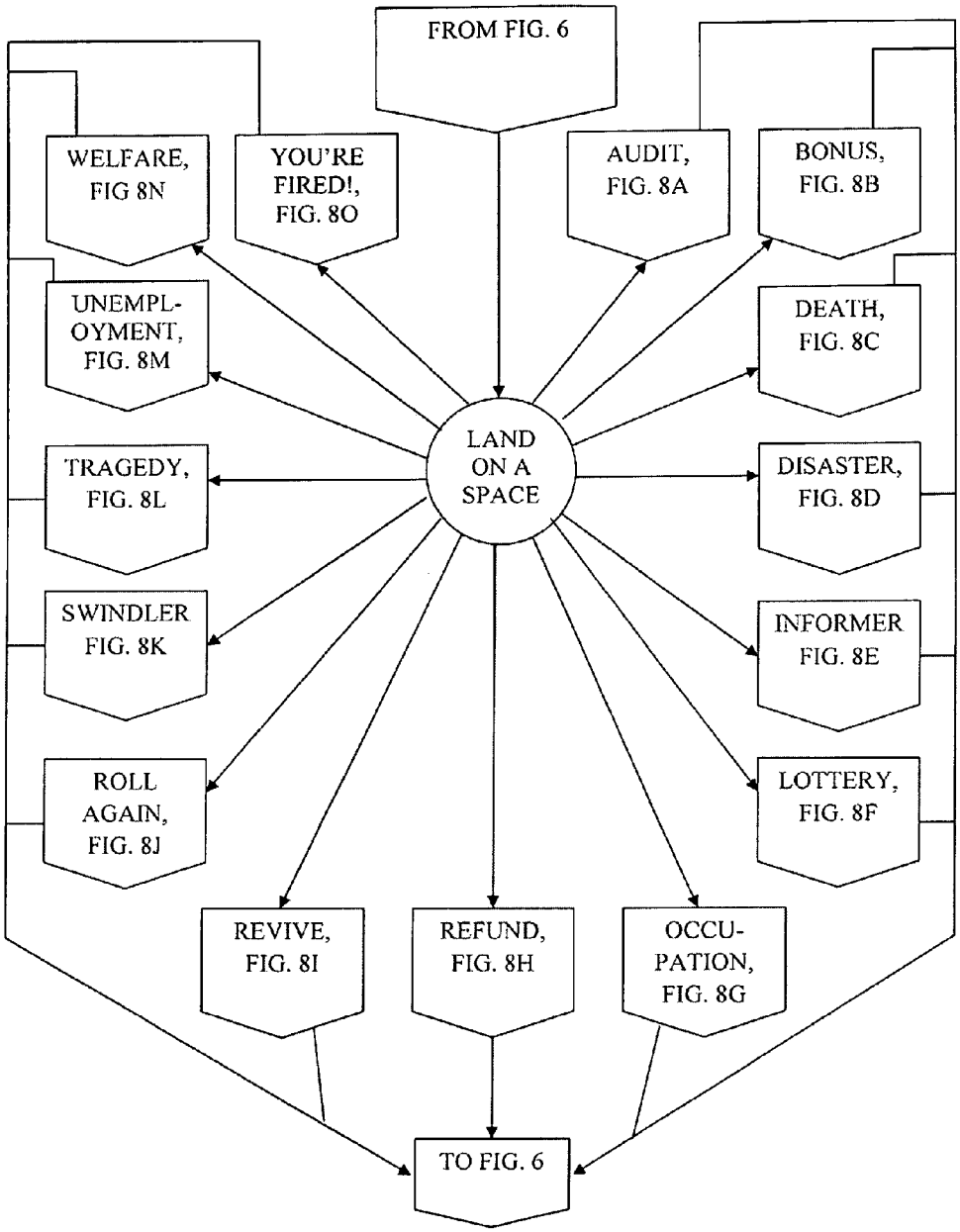
FIG. 8 is a flowchart of the effect of landing on a space.
Figure 8A:
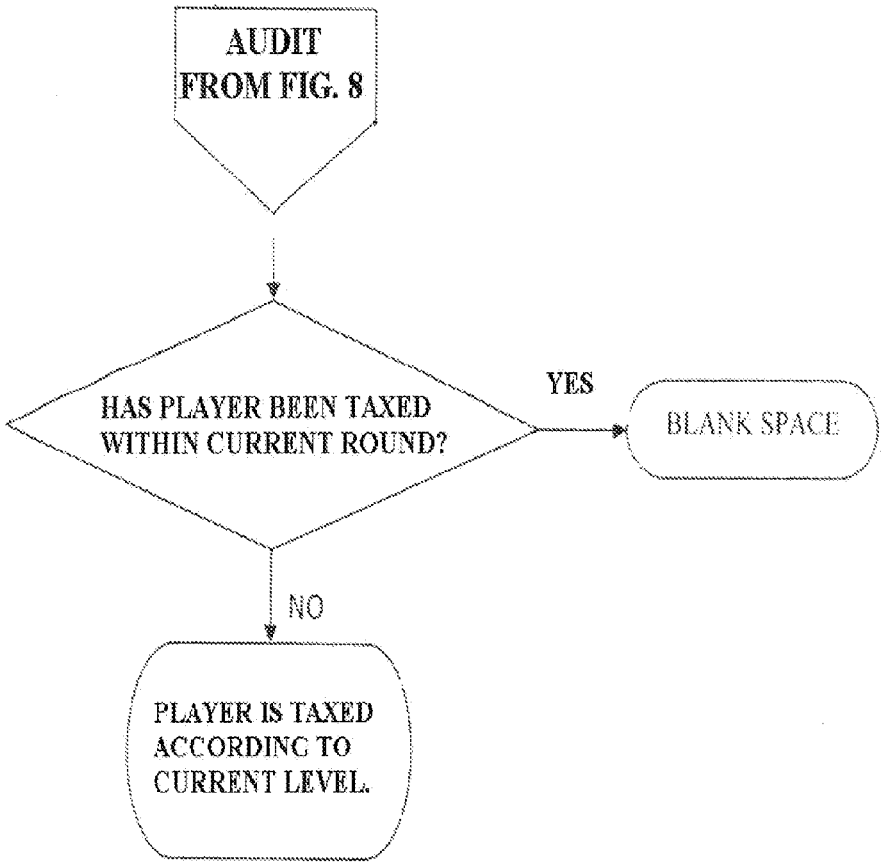
Figure 8B:
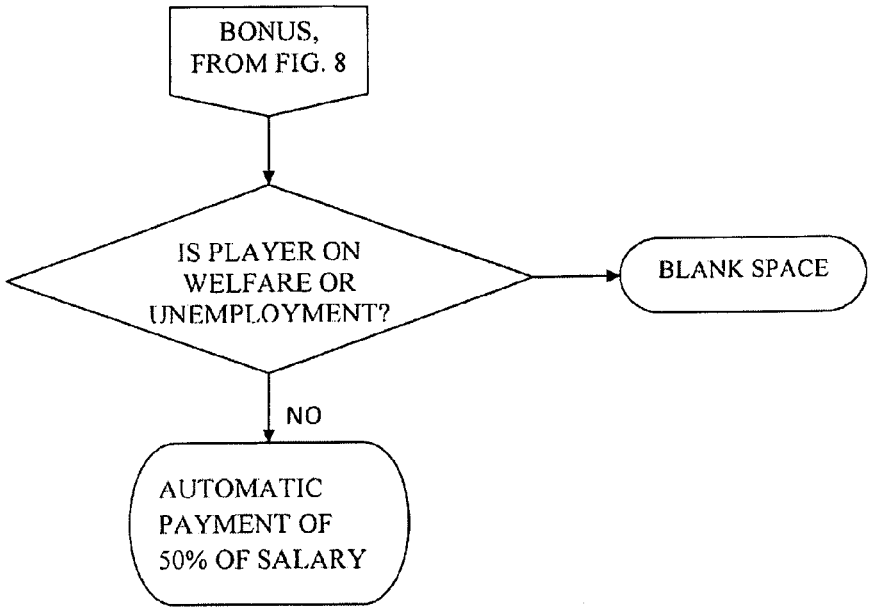
Figure 8C:
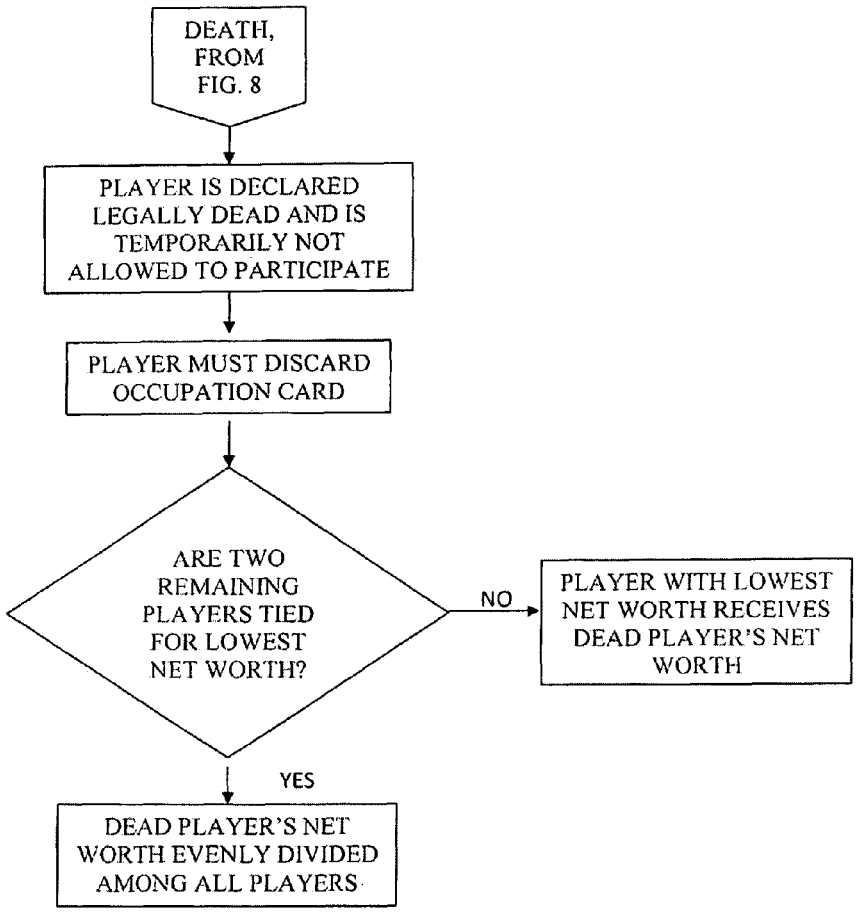
Figure 8D:
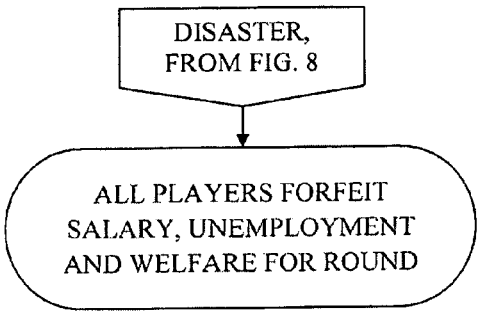
Figure 8E:
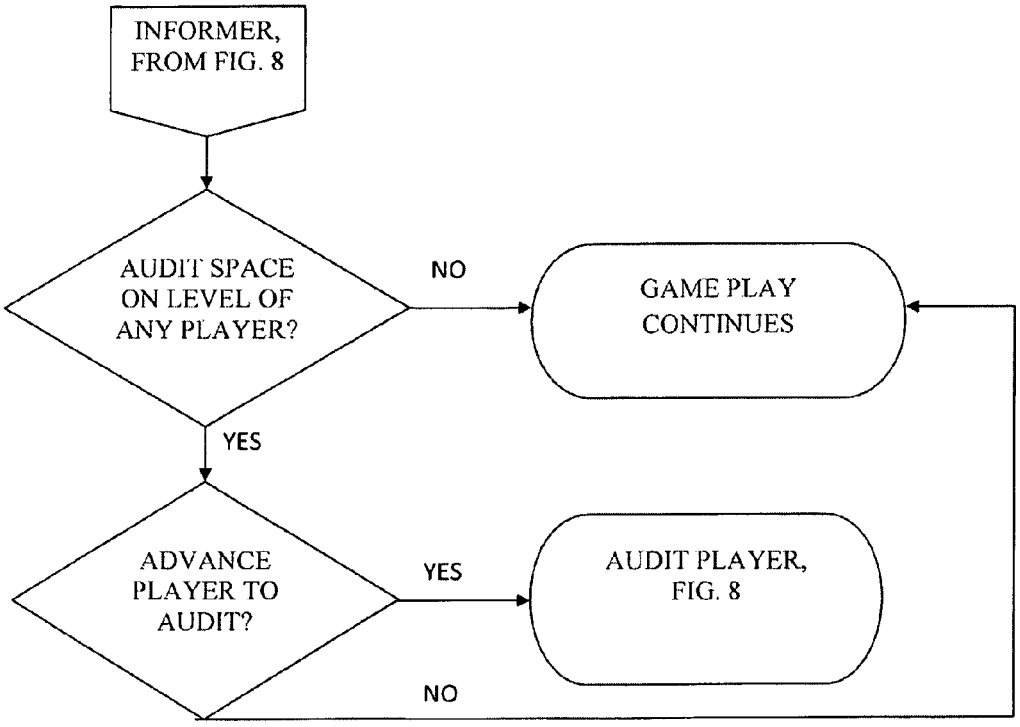
Figure 8F:
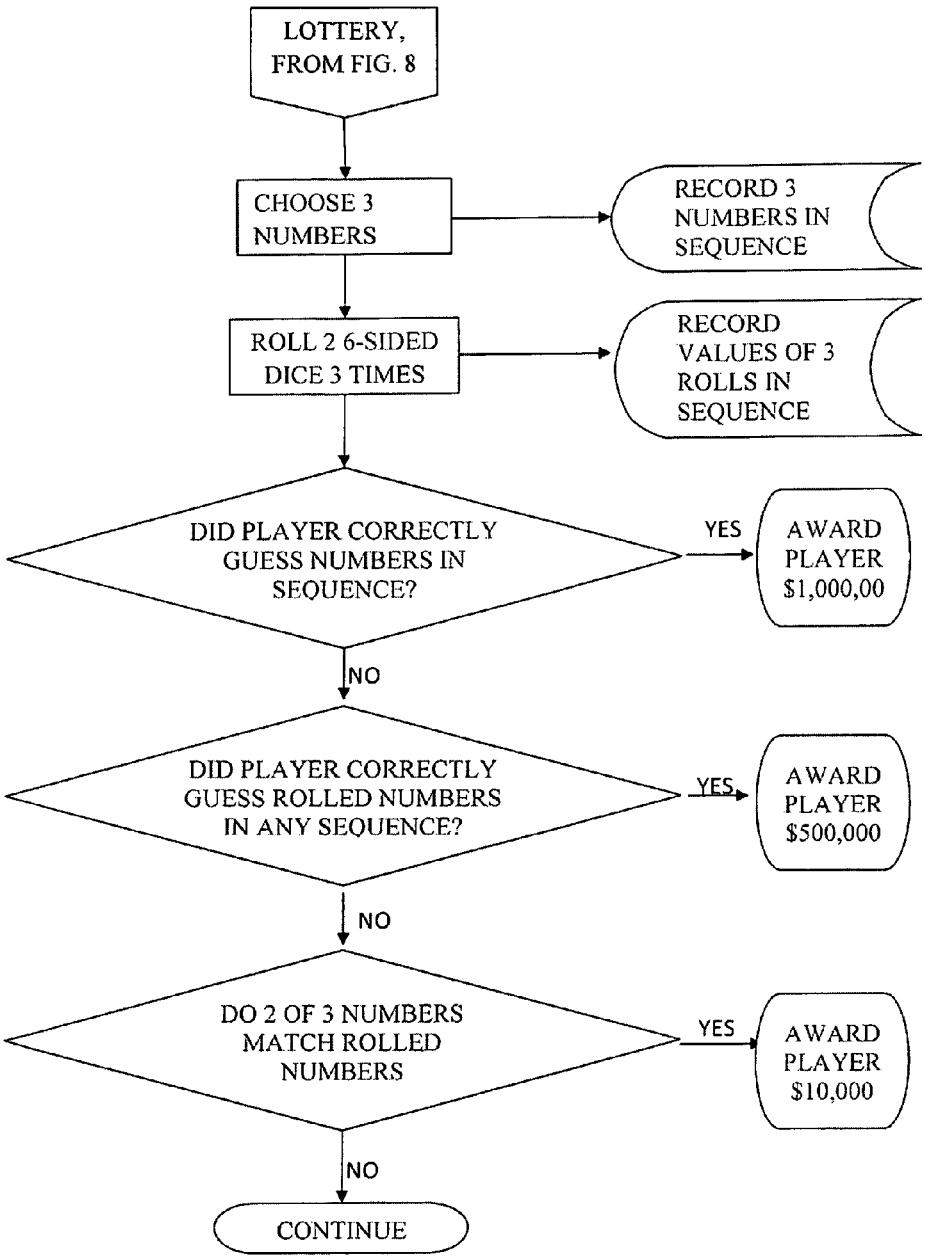
Figure 8G:
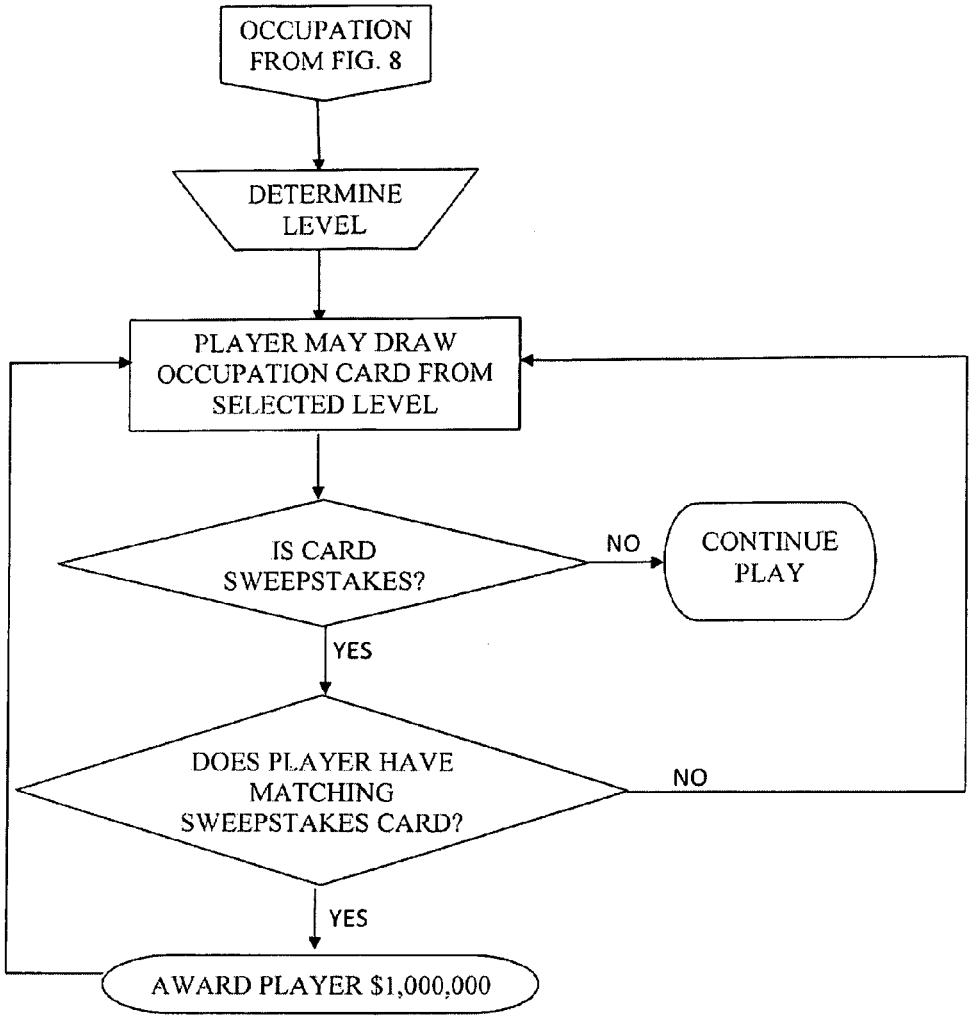
Figure 8H:
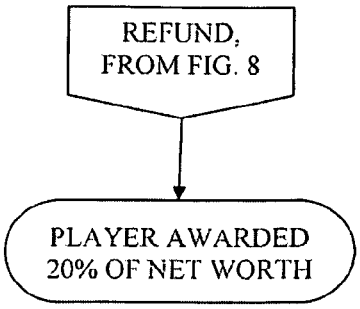
Figure 8I:
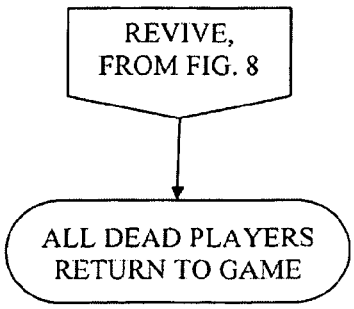
Figure 8J:
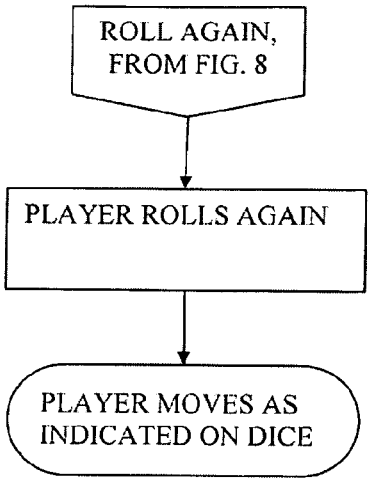
Figure 8K:
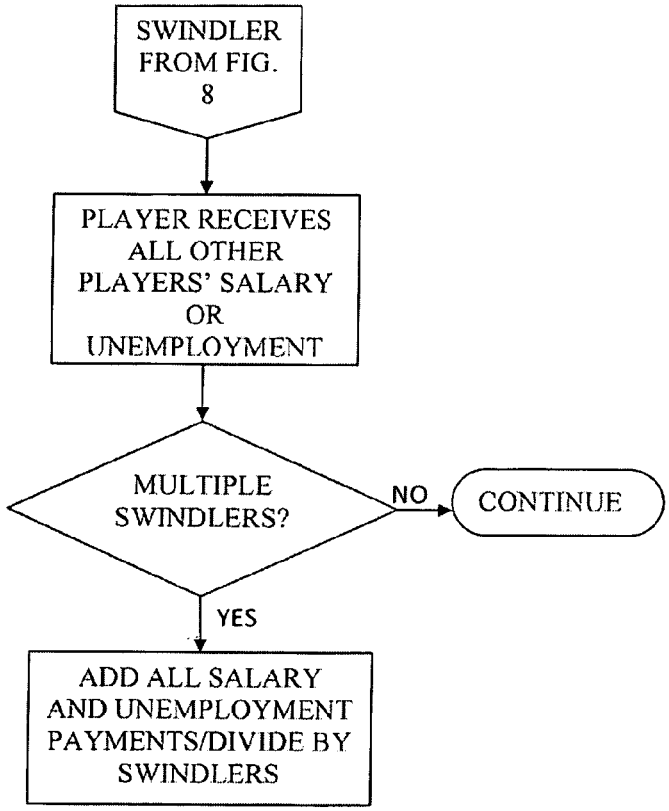
Figure 8L:
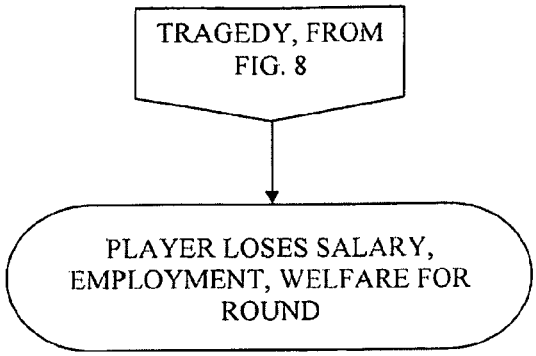
Figure 8M:
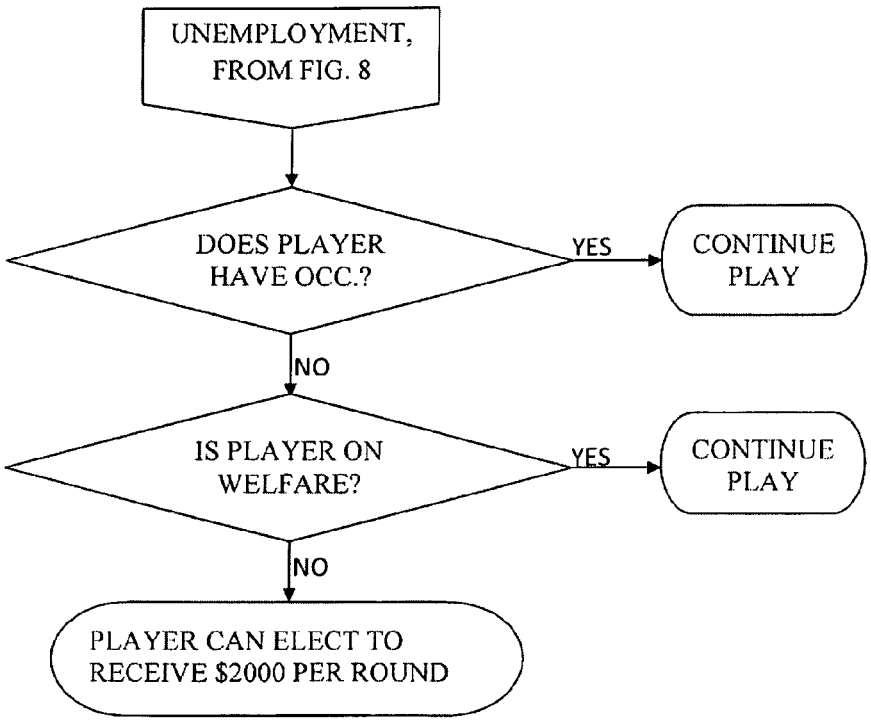
Figure 8N:
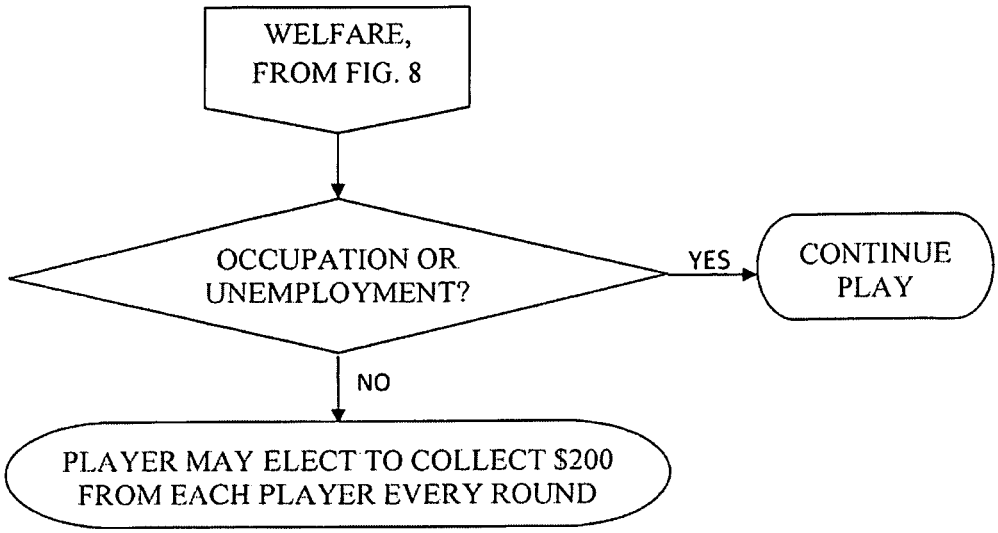
Figure 8O:
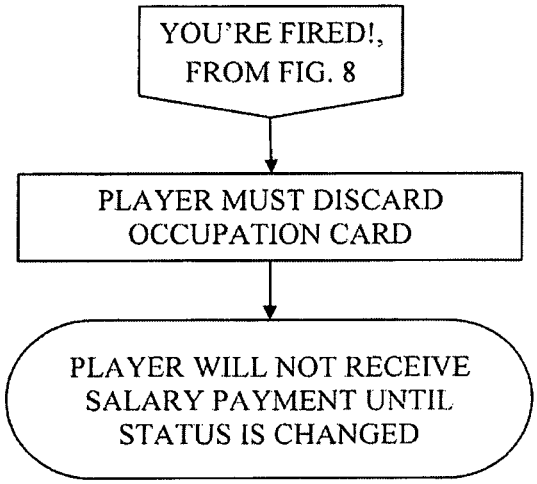

Referring to FIG. 6, a flowchart of the beginning of a turn is depicted. In the initial round of play, each player will start on Level One illustrated at FIG. 2, Level 1, Space 1, and will draw a Level One Occupation Card illustrated in FIG. 3(*a*) in turn. In one embodiment, the player will operate the randomizer by rolling two six-sided dice as shown in FIG. 1(*b*). If the player rolls "Cross-Bones", that player is declared legally dead and is temporarily suspended from game play. "Cross-Bones" is defined as rolling a value of 2 in the range of 2-12 possible with two six-sided dice. Recall that the dice illustrated in FIG. 1(*b*) have drawings of skull and crossbones in place of the integer "one." Alternately, "Cross-Bones" can be the number one on a regular die, or any design emblazoned on the die. If the roll is not "Cross-Bones," the player advances the player's indicator at illustrated in. FIG. 1(*d*) around the game board shown in FIG. 1(*a*), and lands on a space illustrated in FIG. 2, Level 1, and Space 3-13. The possible effects of landing on a space are further defined in FIG. 8, and the operations associated with each space are illustrated in FIG. 8(*a*)-8(*o*). The successive players then repeat the process until the last player has completed that player's turn, signaling the end of the round. In successive turns of play, players within a predetermined range of Net Worth begin the corresponding level by moving the player indicator to the Start Space of that level.

Figure 7:
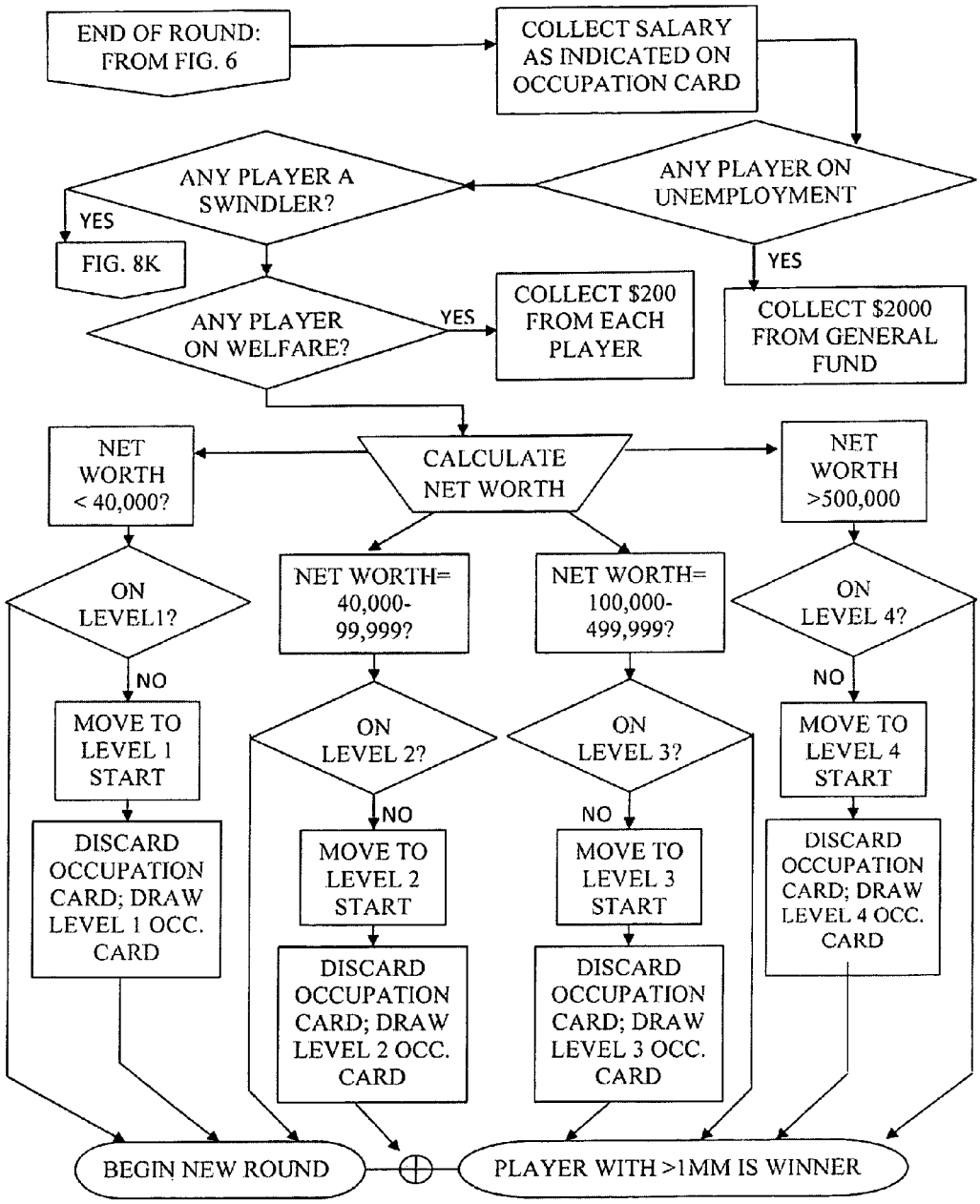
FIG. 7 is a flowchart of the end of a round.

Referring to FIG. 7, a flowchart of the end of a round is depicted. After all players have completed their Turn, each player collects the Salary as Indicated on that player's Occupation Card. If any player is on Unemployment, they add a predetermined amount to their Net Worth. If any Player is a Swindler they perform the operation depicted in FIG. 8(*k*). If any player is on Welfare that player collects a predetermined amount from all the other players. Players then calculate their Net Worth. If the value of Net Worth is sufficient to move a player to a new Level, that player's Player Indicator is moved to the Start Space of the corresponding Level, the player discards the player's Occupation Card, and draws an Occupation Card corresponding to that Level. If any player has a Net Worth exceeding a predetermined amount, that player is declared the winner. Otherwise, a new round begins by next live player clockwise from beginning player operating randomizer. If all but one player is declared legally dead before a player reaches the predetermined amount to be declared the winner, the game ends in a stalemate. In one embodiment, a player on Unemployment will collect $2000 each round and a player on Welfare will take $200 from the other players each round. An example from one embodiment: a player has $38,000 at the end of a Round, during the player's turn the player collects $3,000, and calculates the player's Net Worth at the end of the next Round at $41,000. Because the player's Net Worth is in the Range of $40,000-100,000, the player would move to Level 2 Start illustrated in FIG. 2 Level 2, Space 1, discard the player's Level 1 Occupation Card, and draw a Level 2 Occupation Card.

Referring to FIG. 8(*a*), a flowchart of the operations associated with landing on an Audit Space is depicted. If the player either lands on or is moved to Audit, the player must pay Taxes at a predetermined rate indicated in the space. If the player has been taxed in that Round the player does not pay Taxes again, and game play continues.

Referring to FIG. 8(*b*), a flowchart of the operations associated with landing on a Bonus Space is depicted. If the player has an Occupation Card, the player receives 50% of the Salary indicated, immediately added to the player's Net Worth. If not, the space is treated as blank, and game play continues.

Referring to FIG. 8(*c*), a flowchart of the operations associated with landing on a Death Space is depicted. If the player lands on Death the player is declared legally dead, must discard the player's occupation card, and the player's Net Worth is reduced to zero. If two remaining players are tied for lowest Net Worth, the dead player's Net Worth is Divided among all remaining players. If not, the player with the lowest Net Worth receives the dead player's Net Worth.

Referring to FIG. 8(*d*), a flowchart of the operations associated with landing on a Disaster Space is depicted. If a player lands on Disaster, all players forfeit Salary, Unemployment, and Welfare for that round.

Referring to FIG. 8(*e*), a flowchart of the operations associated with landing on an Informer Space is depicted. If there is an Audit Space on any level a player is currently playing on, the player landing on Informer may move that player to Audit, and perform the operation of FIG. 8(*a*).

Referring to FIG. 8(*f*), a flowchart of the operations associated with landing on a Lottery Space is depicted. If a player lands on Lottery, the player chooses 3 numbers in sequence in a predetermined range. The player then operates the randomizer 3 times to obtain a sequence of three numbers. If the player correctly guessed the numbers obtained by operating the randomizer in sequence, the player wins a predetermined amount of scrip immediately added to the player's Net Worth. If the player correctly guessed the numbers obtained by operating the randomizer in any sequence, the player wins a predetermined amount of scrip immediately added to the player's Net Worth. If the player correctly guessed 2 of 3 numbers obtained by operating the randomizer in any sequence, the player wins a predetermined amount of scrip immediately added to the player's Net Worth. In one embodiment, a player correctly guessing 3 of 3 rolled numbers in sequence would win $1,000,000, a player correctly guessing 3 of 3 rolled numbers in any sequence would win $500,000, and a player correctly guessing 2 of 3 rolled numbers in any sequence would win $10,000.

Referring to FIG. 8(*g*), a flowchart of the operations associated with landing on an Occupation Space is depicted. If a player lands on occupation, that player may discard the player's Occupation Card, if any, and draw an Occupation Card corresponding to the player's level. If the player draws a Sweepstakes Card illustrated in FIG. 4(*a*) and FIG. 4(*b*), the player may redraw until the player receives an Occupation Card.

Referring to FIG. 8(*h*), a flowchart of the operations associated with landing on a Refund Space is depicted. If a player lands on refund, the player is awarded 20% of the player's Net Worth.

Referring to FIG. 8(*i*), a flowchart of the operations associated with landing on a Revive Space is depicted. If a player lands on revive, all dead players return to the game at beginning of next round.

Referring to FIG. 8(*j*), a flowchart of the operations associated with landing on a Roll Again Space is depicted. If a player lands on Roll Again, the player operates the randomizer and moves the player's Player Indicator as indicated on the randomizer.

Referring to FIG. 8(*k*), a flowchart of the operations associated with landing on a Swindler Space is depicted. If a player lands on Swindler, the player receives all other players Salary or Unemployment Payments at the end of the round. If there are multiple Swindlers they all receive other players' Salary and Unemployment Payments and divide it equally among the Swindlers. If all players land on Swindler, payments are made in usual fashion.

Referring to FIG. 8(*l*), a flowchart of the operations associated with landing on a Tragedy Space is depicted. If a player lands on Tragedy, the player loses all Salary, Unemployment, and Welfare for the round.

Referring to FIG. 8(*m*), a flowchart of the operations associated with landing on an Unemployment Space is depicted. If a player does not have an Occupation or Welfare Benefits, the player can elect to receive a predetermined amount per round.

Referring to FIG. 8(*n*), a flowchart of the operations associated with landing on a Welfare Space is depicted. If a player lands on Welfare, and does not have an Occupation or Unemployment benefits, the player can elect to take a predetermined amount of money from each player each round.

Referring to FIG. 8(*o*), a flowchart of the operations associated with landing on a You're Fired! Space is depicted. If a player lands on You're Fired! the player must discard the player's Occupation Card, and is not eligible to receive a Salary until the player's status is changed.

Although the present invention has been described with respect to specific details, it is not intended that such details should be regarded as limitations on the scope of the invention, except to the extent that they are included in the accompanying claims.

I claim:

1. A method of playing a game comprising:

providing a game, the game comprising:

a game board, said game board having a first playing path including a plurality of individually marked spaces, including a starting space, disposed adjacent to each other to form a continuous path in the form of a closed loop, at least one additional playing path of individually marked spaces, including a starting space, disposed adjacent to each other to form at least one additional path in the form of a closed loop, the first playing path and at least one additional play path being entirely separated from each other, some of said spaces corresponding to a game event indicative of a monetary event that affects a net worth of a player at the end of each round of play by adding or subtracting script money to or from a player, each playing path defining a predetermined level of play in terms of the level of monetary consequences for landing on a given space, a set of occupation cards for each level of play, the occupation cards including job title information and a designated salary, the salary amounts increasing from one level of play to the next, a pad of paper sheets, a plurality of player indicator pieces, a randomizer for indicating the number of spaces to be moved by a player, determining the order of play, having each player draw an occupation card, assigning a predetermined amount of script money to each player at the beginning of each level of play, each player operating the randomizer and moving the player indicator piece a corresponding number of spaces, upon landing on a space, each player executing the actions indicated by the space, at the end of a turn determining the amount of script money for each player, which constitutes the net worth of each player, moving the player indicator pieces to the start space of the path level corresponding to net worth of a player, and initiating a second round of play and determining the net worth of each player after each round until a player exceeds a predetermined net worth at which point the player is the winner of the game.

2. A method of playing a game according to claim 1 wherein one of the spaces is designated a swindler space and if a player occupies a swindler space at the end of a round, the player receives the salary amount from all the other players for that round.

3. A method of playing a game according to claim 2 wherein one of the spaces is designated a refund space and the player receives an award of scrip money equal to 20% of their net worth.

4. A method of playing a game according to claim 3 wherein one of the spaces is designated occupation and the player, when occupying this space, may surrender their current occupation card and draw another occupation card.

5. A method of playing a game according to claim 4 wherein one of the spaces is designated a lottery space and wherein when a player occupies a lottery space, the player chooses 3 numbers in sequence and then operates the randomizer 3 times to obtain a sequence of three numbers; the players being awarded scrip money based on the number of numbers that were correctly chosen.

6. The method of claim 5 wherein one of the spaces is designated a disaster space, and when a player moves to a disaster space, all players forfeit salary for that round.

7. The method of claim 6 wherein one of the spaces is designated a unemployment space, and a player occupying that space at the end of the round is awarded a script amount corresponding to predetermined amount depending on the path level.

8. The method of claim 6 wherein one of the spaces is designated a tragedy space and a player occupying a tragedy space loses their salary for the round being played.

9. The method of claim 7 wherein one of the spaces is designated a death space, and a player occupying this space is temporarily not allowed to participate.

10. The method of claim 9 wherein a player who is temporarily not allowed to participate will be allowed to resume play when another player lands on a space designated "revive" or another player rolls a double when the randomizer is a pair of dice.

11. A method of playing a game comprising:

providing a game, the game comprising:

a game board, said game board having a first playing path including a plurality of individually marked spaces, including a starting space, disposed adjacent to each other to form a continuous path in the form of a closed loop;

said spaces including indicia which affects the net worth of each player at the end of round of play;

at least one additional playing path of individually marked spaces, including a starting space, disposed adjacent to each other to form at least one additional path in the form of a closed loop;

the first playing path and at least one additional play path being entirely separated from each other;

some of said spaces corresponding to a game event indicative of a monetary event that may affect the net worth of a player at the end of each round of play;

each playing path defining a predetermined level of play in terms of the level of monetary consequences for landing on a given space;

a set of occupation cards for each level of play, the occupation cards including job title information and a designated salary;

the salary amounts increasing from one level of play to the next;

a pad of paper sheets for recording net worth;

a plurality of player's indicator pieces;

a randomizer for indicating the number of spaces to be moved by a player;

selecting a starting player, operating the randomizer, moving the game piece of that player from a starting space of a first level to a space indicated by the randomizer and executing the actions indicated by the space;

taking turns of all players to complete a round;

after each round, determining an amount of scrip money assigned to each player and moving the game piece of each player to a selected level determined by the amount of scrip money assigned to that player; and continuing turns of all players until a player has reached a designated amount of scrip money or a selected number of players are indicated to be dead.

* * * * *